US005596953A

United States Patent [19]

Hong

[11] Patent Number: 5,596,953

[45] Date of Patent: Jan. 28, 1997

[54] GAS BOILER

[75] Inventor: Woong S. Hong, Incheon, Rep. of Korea

[73] Assignee: Daewoo Electronics Co., Ltd., Seoul, Rep. of Korea

[21] Appl. No.: 580,849

[22] Filed: Dec. 29, 1995

[30] Foreign Application Priority Data

May 31, 1995 [KR] Rep. of Korea ..... 95-14198

[51] Int. Cl.[6] ..... F22B 5/00

[52] U.S. Cl. ..... 122/17; 122/5; 122/6 R; 122/44.1; 122/114

[58] Field of Search ..... 122/5, 6 R, 13.1, 122/17, 44.1, 114, 332, 406.1

*Primary Examiner*—Henry A. Bennett
*Assistant Examiner*—Siddmarth Ohri
*Attorney, Agent, or Firm*—Beveridge, DeGrandi, Weilacher & Young, LLP

[57] ABSTRACT

Disclosed is a gas boiler which has a simple structure, which is easy to be installed, and which is manufactured at a low cost. The typical water tank is partitioned into an upper casing and a lower casing which are capable of communicated with each other. A circulation pump and a three-way valve are mounted to the lower casing in a row in the vertical direction, and a plurality of pipelines are arranged by using the above perpendicular arrangement as a reference. The circulation pump is coupled to the lower casing and the three-way valve is coupled to the circulation pump. Therefore, the size of the gas boiler is minimized and the manufacturing cost thereof is economized.

19 Claims, 5 Drawing Sheets

(PRIOR ART) 10

GAS BOILER

BACKGROUND OF THE INVENTION

1. Field of the Invention

The present invention relates to an improved gas boiler, and more particularly to a gas boiler which has a simple internal pipeline structure, is easy to install, and can be manufactured at a low cost.

2. Description of the Prior Art

Gas boilers of a variety of types have been continuously proposed hitherto for producing hot water and room heating. FIG. 8 illustrates the internal structure of a conventional gas boiler 10 which generally includes a water tank 20, a circulation pump 30, a three way valve 40, a gas-heated heat exchanger 50, and a box accommodating a printed circuit board (hereinafter simply referred to as "PCB box") 70.

Conventional gas boiler 10 additionally includes a water valve 55, a supplementary water valve 57, a fan 60, a gas valve 74, a plurality of pipelines (not shown), and a plurality of electric wires (not shown).

Referring to FIG. 8, gas boiler 10 has a rear plate 12 consisting of steel. Rear plate 12 is joined with a front cover (not shown). Water tank 20 for retaining the heating water is placed on the upper left portion of rear plate 12. A water level sensing unit 80 is installed to the upper portion of water tank 20. Also, a bypass pipe 90 is installed at the upper right portion of water tank 20, which is connected to the upper left portion of heat exchanger 50 arranged to the right of water tank 20.

A heating water tank (not shown) and a combustion chamber 54 are equipped within heat exchanger 50. A gas supply pipe 72 is connected to the lower portion of heat exchanger 50, which supplies a gaseous fuel such as liquefied natural gas (hereinafter referred to as "LNG") or liquefied petroleum gas (hereinafter referred to "LPG") from an external gas source to heat exchanger 50. A gas valve 74 for adjusting the quantity of the LNG or LPG supplied to heat exchanger 50 is positioned in the middle of gas supply pipe 72. Fan 60 underlies heat exchanger 50.

Meanwhile, an overflow pipe 24, a heating water return pipe 26, a first heating water inlet pipe 28, and a supplementary water supply pipe 58 are connected to the bottom portion of water tank 20.

Here, heating water return pipe 26 is a flow path for the heating water returning from a heating place.

First heating water inlet pipe 28, for recirculating the heating water, extends from the lower portion of water tank 20 to be connected to circulation pump 30. Circulation pump 30 is driven by an electric motor (not shown) to raise the pressure of the heating water and circulate the heating water. A second heating water inlet pipe 32 is connected to the upper portion of circulation pump 30. Second heating water inlet pipe 32 extends from circulation pump 30 to be connected to the heating water tank of heat exchanger 50. A pump drain pipe 34 is connected to the lower portion of circulation pump 30. A drain cock 35 is installed at the center of pump drain pipe 34.

Supplementary water supply pipe 58 is connected to a water supply pipe 56. A supplementary water valve 57 is furnished at the middle of supplementary water supply pipe 58, which adjusts the quantity of the supplementary water supplied into water tank 20 via supplementary water supply pipe 58. Water supply pipe 56 provides fresh water and extends from the water source outside gas boiler 10 to enter into the heating water tank of heat exchanger 50. Water valve 55 is mounted in the middle of water supply pipe 56, which adjusts the quantity of the fresh water supplied via water supply pipe 56.

In the upper left portion of heat exchanger 50, water supply pipe 56 is connected to a hot water supply pipe 59, which extends from the left upper portion of heat exchanger 50 to the exterior of gas boiler 10 and supplies the hot water indirectly heated to have a raised temperature within heat exchanger 50 to a user.

Three-way valve 40 is disposed to the right of water supply pipe 56. Three-way valve 40 controls the flow of the heating water. An internal circulation pipe 42 and a heating water supply pipe 52 are connected to the upper portion of three-way valve 40. Internal circulation pipe 42 is connected to first heating water inlet pipe 28, which connects water tank 20 and circulation pump 30. Heating water supply pipe 52 extends from the heating water tank of heat exchanger 50 to be connected to three-way valve 40 via the bottom side of fan 60. A heating water discharge pipe 44, for discharging the heating water from heating water supply pipe 52 to the heating place, is connected to the lower portion of three-way valve 40. PCB box 70 is situated to the right of gas valve 74. The printed circuit board within PCB box 70 controls the operation of gas boiler 10.

The operation of conventional gas boiler 10 constructed as above will be briefly described in connection with the flow of the fluid.

The heating water which returns into gas boiler 10 after executing the room heating is introduced into water tank 20 via heating water return pipe 26. The heating water introduced into the interior of water tank 20 blends with the fresh water supplemented into water tank 20 via supplementary water supply pipe 58, and is provided to the interior of circulation pump 30 via first heating water inlet pipe 28.

The heating water introduced into circulation pump 30 is pressed by the pumping operation of circulation pump 30 to inflow into the heating water tank of heat exchanger 50 via second heating water inlet tube 32. The heating water admitted into the heating water tank is heated by a gas burner (not shown) disposed in combustion chamber 54 of heat exchanger 50. The heating water, whose temperature is raised by the heating, flows into three-way valve 40 via heating water supply pipe 52 extending from the right upper portion of the heating water tank.

At this time, if the operational mode of gas boiler 10 is the a heating mode, three-way valve 40 opens heating water discharge pipe 44 in accordance with a control signal from the printed circuit board to discharge the heating water. The heating water discharged as above is directed to the heating place via the heating water supply pipeline. The heating water which releases the heat returns to water tank 20 via heating water return pipe 26. The heating water admitted in water tank 20 is successively subjected to the above-stated circulation procedure.

In contrast to the above operation, when the operational mode of gas boiler 10 is the hot water mode, three-way valve 40 shuts off heating water discharge pipe 44 in accordance with the control signal from the printed circuit board. Therefore, the heating water having a raised temperature drifts within circulation pump 30 via internal circulation pipe 42. The heating water, which has a raised temperature and is introduced into circulation pump 30, is in turn provided to the heating water tank of heat exchanger 50 via second heating water inlet pipe 32 together with the heating water returning from the heating place by means of the pumping operation of circulation pump 40. The heating water admitted into the heating water tank is heated by the gas burner arranged within combustion chamber 54 as mentioned above. The heating water heated in this manner is introduced into three-way valve 40 via heating water supply pipe 52. Thereafter, the heating water is subjected to the aforestated circulation procedure to drift just within gas boiler 10.

On the other hand, apart from the circulation of the heating water, the fresh water is provided into the heating water tank of heat exchanger 50 via water supply pipe 56. The fresh water flows via water supply pipe 56, which is arranged as a coil within the heating water tank. At this time, the fresh water is changed into hot water of a high temperature by indirectly receiving the heat transmitted from the heating water which has been heated by the gas burner. The hot water prepared as above is guided to the user via hot water supply pipe 59 extending from water supply pipe 56 on the left of heat exchanger 50. Therefore, the hot water is constantly supplied while gas boiler 10 is operating.

However, in conventional gas boiler 10 as described above, there is a long and complicated pipeline for mutually connecting water tank 20, circulation pump 30, three-way valve 40, and heat exchanger 50. This intricate pipeline impedes the free arrangement of the components during the assembling of the gas boiler. Moreover, because that a copper pipe is adopted in consideration of corrosion and a hydraulic pressure in the pipeline of the gas boiler, the long pipeline is a factor in the high manufacturing cost of the conventional boiler. Furthermore, when a breakdown occurs and the gas boiler is repaired, the complicated pipeline requires considerable manpower and time for separating and replacing respective pipes.

U.S. Pat. No. 5,248,085, issued to Niels D. Jensen on the date of Sep. 28, 1993 may be given as one example of simplifying the internal construction of the gas boiler. Here, a switch mechanism placed between a first heat exchanger and a second heat exchanger is formed together with a control mechanism, a shaft, and a middle wall of a circulation pump housing to form one assembly unit, and thereby simplify the internal construction of the gas boiler. However, the Niels D. Jensen's gas boiler constitutes an assembly unit regardless of the position of a water tank, of the circulation and a three-way valve for contriving the simplification of the internal structure to thus fail in accomplishing an indeed simple structure of the complicated pipeline.

SUMMARY OF THE INVENTION

The present invention is devised to solve the foregoing problems. Accordingly, it is an object of the present invention to provide a gas boiler which has few internal pipelines, ensures a higher space utilization ratio, is easy to install, and reduces the manufacturing cost.

To achieve the foregoing objects, the present invention provides a gas boiler comprising;

water tank;

a heat exchanger for heating a first water and a second water;

a circulation pump mounted at the lower portion of the water tank;

a three-way valve mounted at the lower portion of the circulation pump;

a first guide means for supplying the first water to the heat exchanger and for supplying the first water heated within the heat exchanger to a user;

a second guide means for circulating the heated second water between the three-way valve and the heat exchanger by an operation of the three-way valve when the operational mode of the gas boiler is the hot water mode, and for directing the heated second water to a heating place by the operation of the three-way valve when the operational mode of the gas boiler is the heating mode;

a third guide means for guiding the second water which returns from the heating place into the water tank;

a fourth guide means for guiding the second water which has been directed into the water tank into the circulation pump; and a printed circuit board box having a printed circuit board therein for controlling the operation of the gas boiler.

The first guide means comprises a water supply pipe for supplying the first water from a first water supply source outside of the gas boiler to the heat exchanger, and a hot water supply pipe for supplying the first water heated within the heat exchanger to the user. The water supply pipe comprises a water valve for controlling the quantity of the first water supplied into the heat exchanger via the water supply pipe.

The second guide means comprises a second communicating pipe, a first heating water supply pipe, a second heating water supply pipe, and a heating water discharge pipe, whereby the three-way valve shuts off the heating water discharge pipe to upwardly flow the heated second water into the circulation pump via the second communicating pipe when the operational mode of the gas boiler is the hot water mode, and shuts off the second communicating pipe to discharge the heated second water to the heating place via the heating water discharge pipe when the operational mode of the gas boiler is the heating mode.

The second communicating pipe allows the circulation pump to fluid-communicate with the three-way valve, the first heating water supply pipe allows the circulation pump to fluid-communicate with the heat exchanger, and the second heating water supply pipe allows the heat exchanger to fluid-communicate with the three-way valve.

The circulation pump comprises a circulation pump frame having a plurality of coupling holes for coupling the circulation pump to the water tank and the three-way valve, a heating water inlet hole, a pump entrance, a pump space, and a pump drain pipe.

The three-way valve comprises a three-way valve frame having a plurality of coupling holes for coupling the three-way valve to the circulation pump, a ball space, and a spherical ball placed within the ball space.

The ball shuts off the upper end of the heating water discharge pipe to upwardly flow the heated second water into the circulation pump via the second communicating pipe in accordance with a control signal from the printed circuit board when the operational mode of the gas boiler is the hot water mode, and shuts off the lower end of the second communicating pipe to discharge the heated second water via the heating water discharge pipe in accordance with the control signal from the printed circuit board when the operational mode of the gas boiler is the heating mode.

The water tank has a rectangular section, and comprises an upper casing having an opened lower portion and a lower casing having an opened upper portion.

The upper casing comprises a first flange formed along the lower marginal periphery of the upper casing for coupling the upper casing to the lower casing, and the lower casing has an upside-down step shape and comprises a second flange formed along the upper marginal periphery of the lower casing for coupling the upper casing to the lower casing, and a third flange formed along the right marginal periphery of the lower casing for coupling the lower casing to the circulation pump, where the first flange and casing second flange are coupled together, and the third flange is coupled to the circulation pump.

The heat exchanger comprises a heating water tank for retaining the second water, a combustion chamber, and a gas burner for heating the second water retained within the heating water tank.

The third guide means is a heating water return pipe. The fourth guide means is a first communicating pipe. The first communicating pipe extends from the lower right end of the water tank into the circulation pump.

As described above, in the gas boiler according to the present invention, the typical water tank is partitioned into the upper casing. Also, the lower casing, circulation pump valve and three-way valve are successively arranged in series in the longitudinal direction, and then the internal pipeline is furnished within the gas boiler. Therefore, both the first heating water inlet tube for connecting the water tank and the circulation pump, and the internal circulation pipe for connecting the first heating water inlet tube and the three-way valve, which have been heretofore adopted in the conventional gas boiler, are removed. Furthermore, wasteful space within the gas boiler can be reduced. In addition, the pipeline for connecting respective components can be relatively shortened to minimize the size of gas boiler and to reduce the cost of manufacturing the gas boiler.

BRIEF DESCRIPTION OF THE DRAWINGS

The above objects and other advantages of the present invention will become more apparent by describing in detail the preferred embodiment thereof with reference to the attached drawings, in which.

DETAILED DESCRIPTION OF THE PREFERRED EMBODIMENT

A preferred embodiment of a gas boiler according to the present invention will be described with reference to the accompanying drawings.

Figure 1:
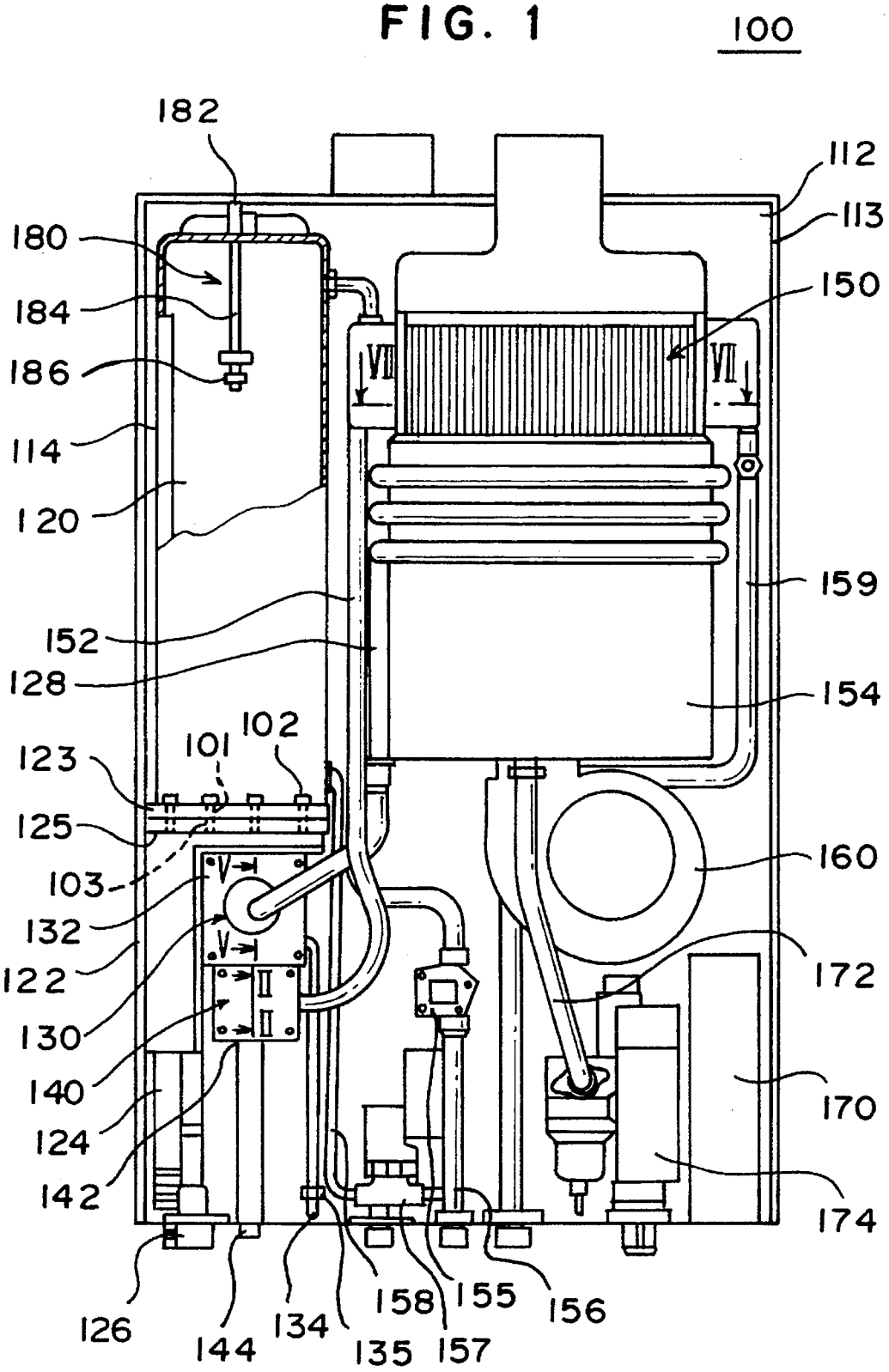
FIG. 1 is a view for showing the internal structure of a gas boiler according to the preferred embodiment of the present invention.

Referring to FIG. 1 gas boiler 100 according to the preferred embodiment of the present invention includes a water tank 114, a circulation pump 130, a three-way valve 140 for controlling the flow of heating water, a gas-heated heat exchanger and a PCB box 170 for controlling an operation of gas boiler 100.

Gas boiler 100 also has a water valve 155, a supplementary water valve 157, a feed fan 160, a gas valve 174, a plurality of pipelines (not shown) and a plurality of electric wires (not shown).

In FIG. 1, gas boiler 100 is equipped with a rear plate 112 composed of a sheet of steel. Rear plate 112 is joined with a front cover (not shown), and a stage 113 is formed along the marginal periphery thereof for facilitating the joining of the rear plate with the front cover. Water tank 114 for retaining the heating water is disposed to the left of rear plate 112. Water tank 114 sectionally has a rectangular shape, which includes an upper casing 120 and a lower casing 122.

A recess 121 is formed in the left side of upper casing 120. PCB box 170 is placed within recess 121. The lower portion of upper casing 120 is open to be communicated with lower casing 122. A first flange 123 is formed along the lower marginal periphery of upper casing 120 to couple with lower casing 122. A plurality of screw holes 101 is formed in first flange 123.

A water level sensing unit 180 is installed in the upper portion of upper casing 120. Water level sensing unit 180 forces the water level of the heating water retained within water tank 114 to maintain the proper height. Preferably, water level sensing unit 180 is a water gauge. Water level sensing unit 180 includes a fixture 182, a column 184 and a water level sensor 186. Fixture 182 is provided at the ceiling of upper casing 120. Column 184 extends from fixture 182 into the interior of water tank 114. Water level sensor 186 is attached to the end of column 184.

The upper portion of upper casing 120 is equipped with a bypass pipe 190 which is connected to the upper left portion of heat exchanger 150 situated in the right of upper casing 120. Bypass pipe 190 is a flow path for permitting water bubbles generated from the heating water of high temperature to drift within heat exchanger 150.

Figure 7:
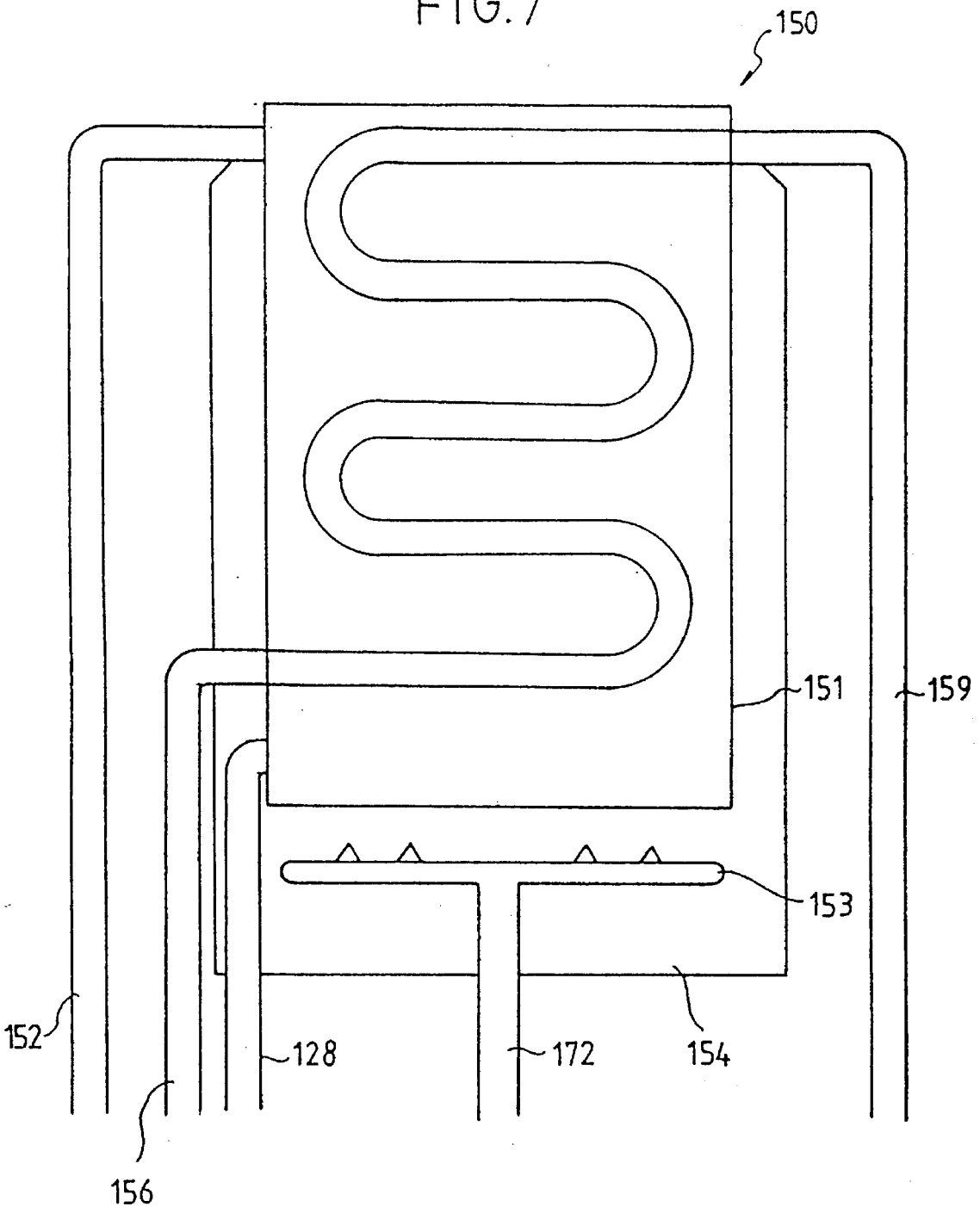
FIG. 7 is a cross section view taken along line VII—VII of FIG. 1.
Figure 8:
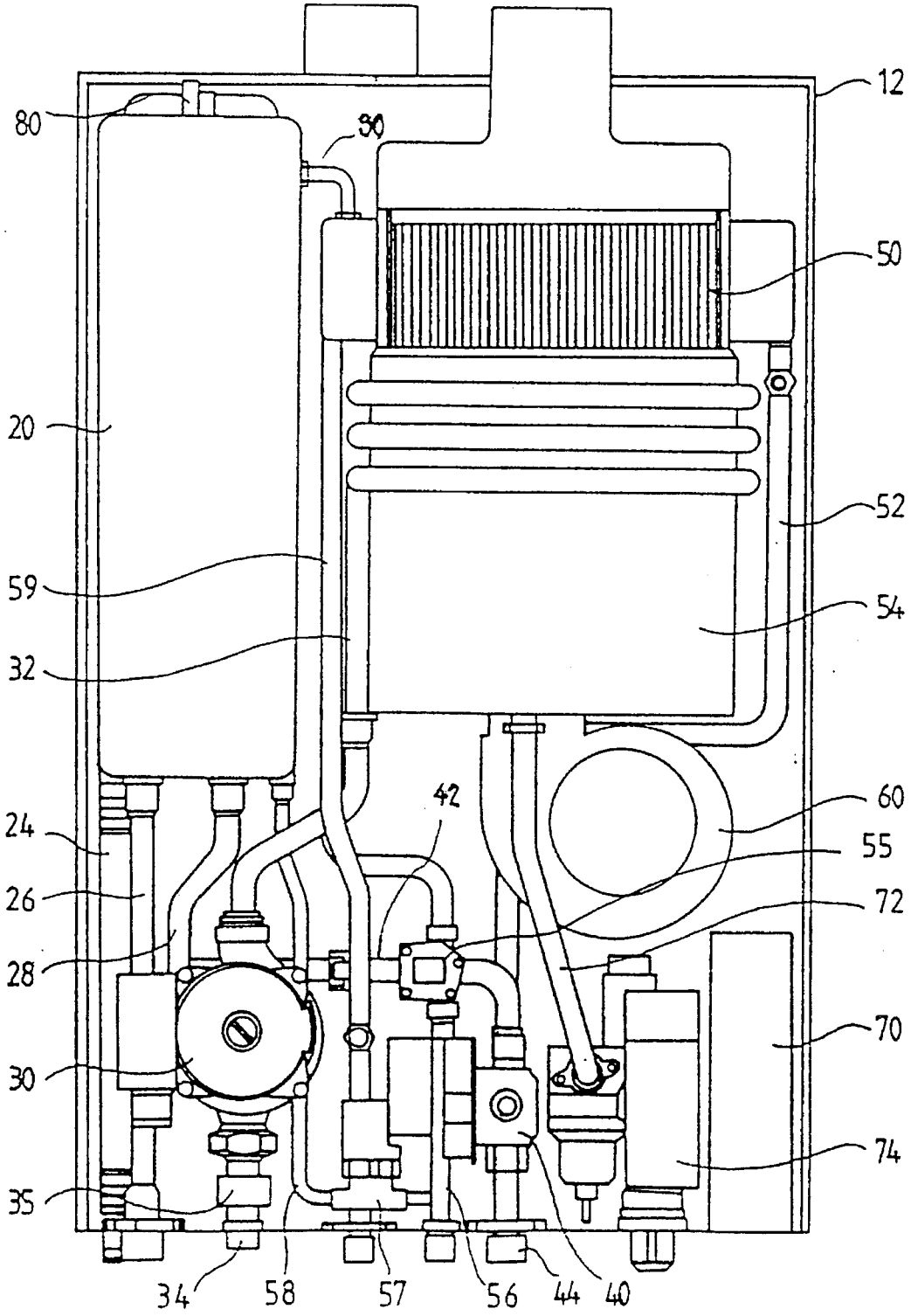
FIG. 8 is a view showing the internal structure of a conventional gas boiler.

Heat exchanger 150, as shown in FIG. 7, includes a heating water tank 151 for retaining the heating water supplied from first heating water supply pipe 128, a combustion chamber 154, and a gas burner 153 for heating the heating water housed within heating water tank 151. A water supply pipe 156 running from the lower left portion of heat exchanger 150 is arranged within heating water tank 151 as a coil. Gas burner 153 is connected with a gas supply pipe 172. Gas supply pipe 172 provides gaseous fuel, such as LNG or LPG, from an external gas source (not shown) to gas burner 153.

As illustrated in FIG. 1, gas supply pipe 172 extends from the external gas source of gas boiler 100 to flow into combustion chamber 154. A gas valve 174 is disposed in the middle of gas supply pipe 172. Gas valve 172 adjusts the quantity of the gas supplied to gas burner 153 via gas supply pipe 172. Feed fan 160 is installed below heat exchanger 150. Feed fan 160 provides air into heat exchanger 150 to assist the combustion of the gas and to prevent a gas explosion within combustion chamber 154.

The upper plane of lower casing 122 is open to be communicated with upper casing 120. Lower casing 122 is formed in the shape of an upside-down step. A second flange 125 is formed along the upper marginal periphery of lower casing 122 for connecting lower casing 122 to upper casing 120. A plurality of screw holes 103 is formed in second flange 125 so as to correspond to a plurality of screw holes 101 formed in first flange 123. Upper casing 120 and lower casing 122 are coupled to each other by means of a plurality of screws 102 which pierce through screw holes 101 and 103. Upper casing 120 and lower casing 122 are coupled to each other tight enough to prevent water leakage and to endure the heating water pressure.

An overflow pipe 124 and a heating water return pipe 126 are installed at the lower left portion of lower casing 122. Overflow pipe 124 penetrates through the bottom of lower casing 122 to extend into upper casing 120. Overflow pipe 124 is installed for externally draining the expansion pressure of the heating water resulting from the heating. An upper end of overflow pipe 124 extends just below bypass pipe 190 such that the upper end is higher than the highest water level of the heating water within water tank 114. Heating water return pipe 126 is a flow path for the heating water that returns from a heating place to lower casing 122.

A third flange 127 is formed at the right marginal periphery of lower casing 122 for connecting circulation pump 130, which is placed on the right of lower casing 122 to lower casing 122. Third flange 127 has a plurality of screw holes 105.

On the right of lower casing 122, circulation pump 130 and three-way valve 140 are sequentially disposed in the perpendicular direction. Circulation pump 130 is driven by an electric motor (not shown) to raise the pressure of the heating water and to circulate the heating water. First heating water supply pipe 128 is connected to the center of circulation pump 130, which connects circulation pump 130 and heat exchanger 150. Circulation pump 130 is provided with a circulation pump frame 132 for mounting circulation pump 130 to lower casing 122 and three-way valve 140. A pump drain pipe 134 is connected to the lower right end of circulation pump 130. A drain cock 135 is installed on pump drain pipe 134.

Three-way valve 140 is located at the lower portion of circulation pump 130. Second heating water supply pipe 152 is connected to the right of three-way valve 140. Second heating water supply pipe 152 connects three-way valve 140 to heat exchanger 150. A heating water discharge pipe 144 is connected to the lower portion of three way valve 140. Also, three-way valve 140 is equipped with a three-way valve frame 142 for mounting three-way valve 140 onto circulation pump 130.

Water supply pipe 156 is perpendicularly arranged to the right of circulation pump 130 and three-way valve 140. Water supply pipe 156, for supplying fresh water into gas boiler 100 extends from a water source outside gas boiler 100 which is to be admitted into heating water tank 151 (refer to FIG. 7) of heat exchanger 150 after passing through the right of circulation pump 130. Water valve 155 is installed in the middle of water supply pipe 156. Water valve 155 adjusts the quantity of the fresh water introduced into heat exchanger 150 via water supply pipe 156. Water supply pipe 156, running heating water tank 151 of heat exchanger 150, is arranged as the coil to extend to the upper right portion of heat exchanger 150. Water supply pipe 156 is connected to a hot water supply pipe 159 at the upper right portion of heat exchanger 150. Hot water supply pipe 159 externally extends downward under feed fan 160, which is mounted below heat exchanger 150.

On the other hand, supplementary water supply pipe 158 is installed between upper casing 120 and water supply pipe 156. Supplementary water supply pipe 158 enables the supplying of the fresh water which is the supplementary water into water tank 114. Supplementary water valve 157 is installed in the middle of supplementary water supply pipe 158. Supplementary water valve 157 adjusts the quantity of the fresh water supplied via supplementary water supply pipe 158 into upper casing 120 and and lower casing 122.

Hereinafter, the construction of lower casing 122, circulation pump 130, and three-way valve 140 will be described in detail with reference to FIGS. 2 to 7.

Figure 2:
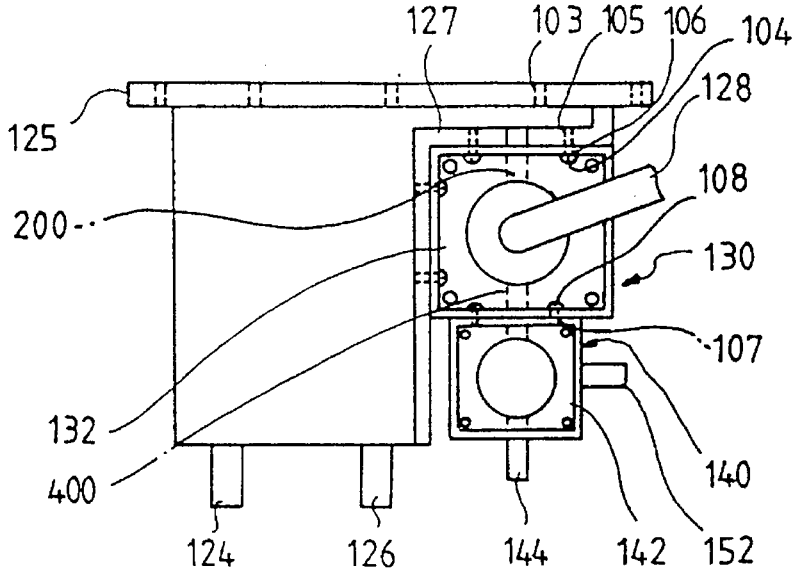
FIG. 2 is a view for partially showing the structure of the gas boiler shown in FIG. 1, which is a front view for showing a water tank, a circulation pump and a three-way valve.

First, in FIG. 2, lower casing 122 has second flange 125 formed along the upper marginal periphery of lower casing 122. Second flange 125 contains a plurality of screw holes 103 corresponding to a plurality of screw holes 101 formed in first flange 123. Lower casing 122 further has third flange 127 which is projected to be coupled with circulation pump 130 disposed on the right of lower casing 122. Third flange 127 contains a plurality of screw holes 105 for coupling lower casing 122 to circulation pump 130. Lower casing 122 is fluid-communicated with circulation pump 130 by means of first communicating pipe 200, which extends into circulation pump 130 by piercing through third flange 127.

Circulation pump 130 includes a circular circulation pump frame 132 for connecting circulation pump 130 to lower casing 122 and to three-way valve 140. A plurality of screw holes 106 are formed in the upper, left, and lower marginal peripheries of circulation pump frame 132 for coupling circulation pump 130 to lower casing 122 and to three-way valve 140. Lower casing 122 and circulation pump 130 are coupled by screws 104 penetrating through screw holes 105 and 106.

Figure 5:
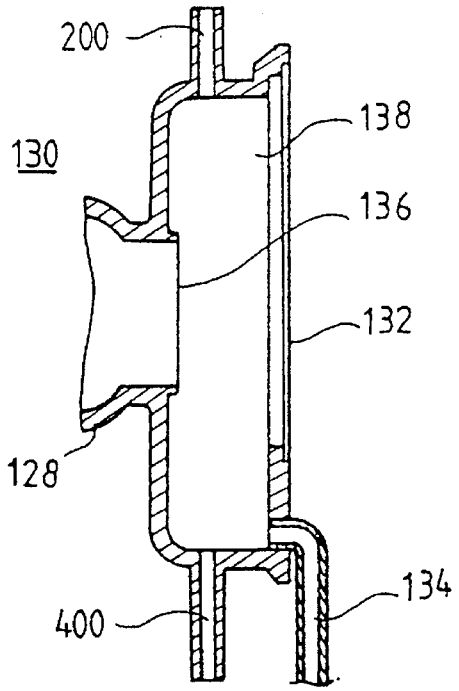
FIG. 5 is a vertical section view taken along a line V—V of FIG. 1 for showing the circulation pump.
Figure 6:
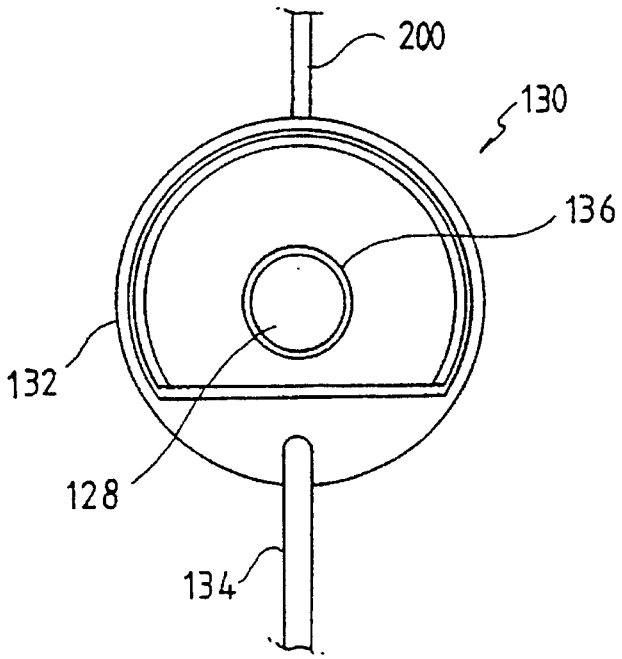
FIG. 6 is a right side view of the circulation pump shown in FIG. 5.

As illustrated in FIGS. 5 and 6, first communicating pipe 200, for being communicated with lower casing 122, is connected to the upper portion of circulation pump 130. A pump space 138 is provided at the center of circulation pump 130. A heating water inlet hole 136 connected to first heating water supply pipe 128 is formed at the center of circulation pump 130. A second communicating pipe 400 and a pump drain pipe 134 are connected to the lower portion of circulation pump 130. Second communicating pipe 400 allows circulation pump 130 to communicate with three-way valve 140 which is positioned below circulation pump 130. Pump drain pipe 134 discharges some heating water for exchanging the heating water as described above.

Referring to FIG. 2, three-way valve 140 is disposed on the lower portion of circulation pump frame 132. Three-way valve 140 is equipped with three-way valve frame 142 for mounting three-way valve 140 to circulation pump 130. A plurality of screw holes 107 are formed at the upper portion of three-way valve frame 142 to allow three-way valve 140 to couple with circulation pump 130. A plurality of screw holes 107 correspond to a plurality of screw holes 106 formed at the lower marginal periphery of circulation pump frame 132. Three-way valve 140 is connected to circulation pump 130 by means of screws 108 piercing through screw holes 106 and 107.

Figure 3:
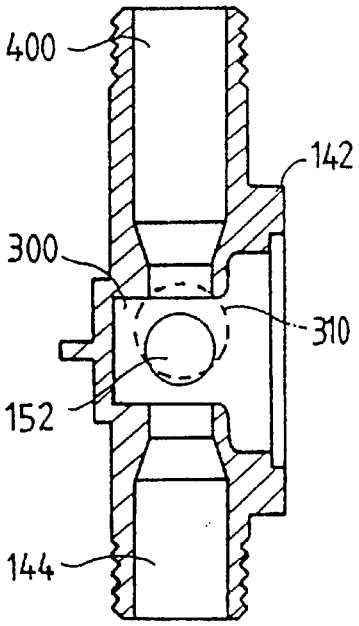
FIG. 3 is a view for showing the gas boiler taken along line III—III of FIG. 1, which is a vertical section view of the three-way valve for showing the position of the ball of the three-way valve when the operational mode of the gas boiler is the heating mode.
Figure 4:
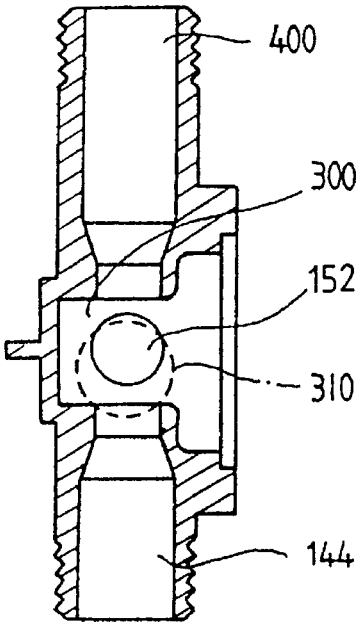
FIG. 4 is a vertical section view of the three-way valve shown in FIG. 1 for showing the position of the ball of the three-way valve when the operational mode of the gas boiler is the hot water mode.

As shown in FIGS. 3 and 4, second communicating pipe 400 is connected to the upper portion of three-way valve 140, which communicates circulation pump 130 with three-way valve 140. A ball space 300 is provided at the center of three-way valve 140, in which a spherical ball 310 is placed for selectively shutting off the lower end of second communicating pipe 400 and heating water discharge pipe 144, as required. A second heating water supply pipe 152 is connected to the center of ball space 300 introducing the heating water having a raised temperature in heat exchanger 150 into three-way valve 140.

In the above description, three-way valve 140 is substantially identical with three-way valve 40, which has been typically adopted in conventional gas boiler 10. Three way valve 140 is operated by a control signal from a printed circuit board housed within PCB box 170 of gas boiler 100.

An operation of gas boiler 100 according to the preferred embodiment of the present invention constructed as above will be described in connection with the flow of fluid.

To begin with, the heating water which returns to gas boiler 100 since the temperature thereof is lowered after executing room heating, is introduced into lower casing 122 and upper casing 120 via heating water return pipe 126. The heating water which has been introduced into upper casing 120 and lower casing 122 is mixed with the supplementary water, which is the fresh water which is introduced into upper casing 120 via supplementary water supply pipe 158 connected to the right lower end of upper casing 120. The heating water mixed with the supplementary water passes through first communicating pipe 200, which extends from the upper right end of lower casing 122 to pump space 138 within circulation pump 130, and then flows into pump space 138 of circulation pump 130.

When the operational mode of gas boiler 100 is the heating mode, spherical ball 310 placed in ball space 300 of three-way valve 140 shuts off the lower end of second communicating pipe 400 in the way indicated by the dotted line in FIG. 3, in accordance with the control signal from the printed circuit board. Thus, the heating water which has been introduced into pump space 138 of circulation pump 130 is pressed by the pumping operation of circulation pump 130 to flow into heating water tank 151 of heat exchanger 150 via first heating water supply pipe 128 connected to heating water inlet hole 136 of circulation pump 130. The heating water which flows into heating water tank 151 is heated by gas burner 153 in combustion chamber 154 of heat exchanger 150. That is, gas burner 153 burns the LNG or LPG supplied via gas supply pipe 172 to heat the heating water. The heating water having a temperature raised by the heating is directed into three-way valve 140 via second heating water supply pipe 152 extending from the upper left portion of heating water tank 151.

The heating water which has been directed from second heating water supply pipe 152 into three-way valve 140 is discharged via heating water discharge pipe 144 and via ball space 300 of three-way valve 140 in association with the operation of spherical ball 310 of three-way valve 140, which shuts off the lower end of second communicating pipe 400 while opening heating water discharge pipe 144. The heating water discharged as above is transferred to the heating place via the heating water pipeline.

The heating water which has released the heat in the heating place returns into lower casing 122 and upper casing 120 via heating water return pipe 126. The heating water which has been introduced into upper casing 120 and into lower casing 122 is mixed with the supplementary water which is the fresh water supplemented into upper casing 120 via supplementary water pipe 158, as described above. The heating water which has been mixed with the supplementary water flows into pump space 138 of circulation pump 130 via first communicating pipe 200.

On the other hand, unlike the circulation of the heating water, the fresh water is supplied into heating water tank 151 of heat exchanger 150 via water supply pipe 156. The fresh water flows via coil-shaped water supply pipe 156 within heating water tank 151. At this time, the fresh water is changed into the hot water of high temperature by indirectly receiving the heat from the heating water heated by gas burner 153 within heat exchanger 150. The hot water prepared as above is guided to the user via hot water supply pipe 159 extending from water supply pipe 156, which is on the right of heat exchanger 150. Therefore, the heating water and hot water are simultaneously supplied when gas boiler 100 is in the heating mode state.

When the operational mode of gas boiler 100 is in the hot water mode, three-way valve 140 shuts off heating water discharge pipe 144 in the way indicated by the dotted line shown in FIG. 4, to drift the heating water only within gas boiler 100. More specifically, ball 300 of three-way valve 140, which shut off the lower end of second communicating pipe 400 in the heating mode, is moved in accordance with the control signal from the printed circuit board to shut off the upper end of heating water discharge pipe 144 when the operational mode of gas boiler 100 is changed to the hot water mode. Thus, the heating water having a raised temperature upwardly flows into pump space 138 of circulation pump 130 via second communicating pipe 400. The heating water having a raised temperature which has been introduced into circulation pump 130 is then pressed by the pumping operation of circulation pump 130 together with the heating water which has been introduced into pump space 138 of circulation pump 130 via first communicating pipe 200 from lower casing 122 to be supplied into heating water tank 151 of heat exchanger 150 via first heating water supply pipe 128. The heating water which has been introduced into heating water tank 151 is heated by gas burner 153, which is arranged within combustion chamber 154 as mentioned above. The heating water heated in this manner is introduced into three-way valve 140 via second heating water supply pipe 152. Thereafter, the heating water is subjected to the aforestated circulation procedure to drift just within gas boiler 100.

Meanwhile, hot water is supplied apart from the circulation of the heating water within gas boiler 100. That is, as described above, the fresh water introduced into heating water tank 151 of heat exchanger 150 via water supply pipe 156 passes through water supply pipe 156, which is arranged as the coil within heating water tank 151. At this time, the fresh water is changed into hot water of high temperature by indirectly receiving the heat from the heating water heated by gas burner 153 within heat exchanger 150. The hot water obtained as above is guided to the user via hot water supply pipe 159 extending from the right of heat exchanger 150. Therefore, the hot water is solely supplied independent of the heating operation when gas boiler 100 is in the hot water mode.

In the gas boiler according to the preferred embodiment of the present invention constructed as above, lower casing 122 of water tank 114, circulation pump 130, and three-way valve 140 are successively arranged in a row in the vertical direction. Then, the internal pipeline work of gas boiler 100 is executed so that first heating water inlet pipe 28, for connecting water tank 20 to circulation pump 30 in conventional gas boiler 10, is removed, and internal circulation pipe 42, for connecting first heating water inlet pipe 28 to three-way valve 40 is subsequently removed. Thus, the wasteful space within gas boiler 10 can be reduced. In addition, the length of other pipelines for connecting respective components is relatively shortened. Thus, the gas boiler' size can be minimized and the manufacturing cost of the gas boiler is reduced.

While the present invention has been particularly shown and described with reference to a particular embodiment thereof, it will be understood by those skilled in the art that various changes in form and detail may be effected therein without departing from the spirit and scope of the invention, which is defined by the appended claims.

What is claimed is:

1. A gas boiler comprising:

a water tank;

a heat exchanger for heating a first water and a second water;

a circulation pump mounted at the lower portion of said water tank;

a three-way valve mounted at the lower portion of said circulation pump;

a first guide means for supplying the first water to said heat exchanger and for supplying the first water heated within said heat exchanger to a user;

a second guide means for circulating the heated second water between said three-way valve and said heat exchanger by an operation of said three-way valve when the operational mode of said gas boiler is the hot water mode, and for directing the heated second water to a heating place by the operation of said three-way valve when the operational mode of said gas boiler is the heating mode;

a third guide means for guiding the second water which returns from the heating place into said water tank;

a fourth guide means for guiding the second water which has been directed into said water tank into said circulation pump; and a printed circuit board box having a printed circuit board therein for controlling the operation of said gas boiler.

2. A gas boiler as claimed in claim 1, wherein said first guide means comprises a water supply pipe for supplying the first water from a first water supply source outside of said gas boiler to said heat exchanger, and a hot water supply pipe for supplying the first water heated within said heat exchanger to the user.

3. A gas boiler as claimed in claim 2, wherein said water supply pipe comprises a water valve for controlling the quantity of the first water supplied into said heat exchanger via said water supply pipe.

4. A gas boiler as claimed in claim 1, wherein said second guide means comprises a second communicating pipe, a first heating water supply pipe, a second heating water supply pipe, and a heating water discharge pipe, whereby said three-way valve shuts off said heating water discharge pipe to upwardly flow the heated second water into said circulation pump via said second communicating pipe when the operational mode of said gas boiler is the hot water mode, and shuts off said second communicating pipe to discharge the heated second water to the heating place via said heating water discharge pipe when the operational mode of said gas boiler is the heating mode.

5. A gas boiler as claimed in claim 4, wherein said second communicating pipe allows said circulation pump to fluid-communicate with said three-way valve, said first heating water supply pipe allows said circulation pump to fluid-communicate with said heat exchanger, and said second heating water supply pipe allows said heat exchanger to fluid-communicate with said three-way valve.

6. A gas boiler as claimed in claim 1, wherein said circulation pump comprises a circulation pump frame having a plurality of coupling holes for coupling said circulation pump to said water tank and said three-way valve, a heating water inlet hole, a pump entrance, a pump space, and a pump drain pipe.

7. A gas boiler as claimed in claim 1, wherein said three-way valve comprises a three-way valve frame having a plurality of coupling holes for coupling said three-way valve to said circulation pump, a ball space, and a spherical ball placed within said ball space.

8. A gas boiler as claimed in claim 7, wherein said ball shuts off the upper end of said heating water discharge pipe to upwardly flow the heated second water into said circulation pump via said second communicating pipe in accordance with a control signal from the printed circuit board when the operational mode of said gas boiler is the hot water mode, and shuts off the lower end of said second communicating pipe to discharge the heated second water via said heating water discharge pipe in accordance with the control signal from the printed circuit board when the operational mode of said gas boiler is the heating mode.

9. A gas boiler as claimed in claim 1, wherein said water tank has a rectangular section, and comprises an upper casing having an opened lower portion and a lower casing having an opened upper portion.

10. A gas boiler as claimed in claim 9, wherein said upper casing comprises a first flange formed along the lower marginal periphery of said upper casing for coupling said upper casing to said lower casing, and said lower casing has an upside-down step shape and comprises a second flange formed along the upper marginal periphery of said lower casing for coupling said upper casing to said lower casing, and a third flange formed along the right marginal periphery of said lower casing for coupling said lower casing to said circulation pump, where said first flange and said second flange are coupled together, and said third flange is coupled to said circulation pump.

11. A gas boiler as claimed in claim 1, wherein said heat exchanger comprises a heating water tank for retaining the second water, a combustion chamber, and a gas burner for heating the second water retained within said heating water tank.

12. A gas boiler as claimed in claim 1, wherein said third guide means is a heating water return pipe.

13. A gas boiler as claimed in claim 1, wherein said fourth guide means is a first communicating pipe.

14. A gas boiler as claimed in claim 13, wherein said first communicating pipe extends from the lower right end of said water tank into said circulation pump.

15. A gas boiler comprising:

a water tank having a rectangular section, and including an upper casing having a lower portion opened and a lower casing having an upper portion opened, said upper casing includes a first flange formed along the lower marginal periphery of said upper casing for coupling said upper casing to said lower casing, and said lower casing shaped as an upside-down step includes a second flange formed along the upper marginal periphery of said lower casing for coupling said upper casing to said lower casing, and includes a third flange formed along the right marginal periphery of said lower casing whereby said first flange and said second flange are coupled together;

a heat exchanger for heating a first water and a second water, and which includes a heat exchanger which comprises a heating water tank for retaining the second water, a combustion chamber, and a gas burner for heating the second water retained within said heating water tank;

a circulation pump, which is mounted to the lower portion of said water tank and includes a circulation pump frame formed with a plurality of coupling holes for joining said circulation pump to said water tank and to said three-way valve, a heating water inlet hole, a pump entrance, a pump space, and a pump drain pipe;

a three-way valve, mounted to the lower portion of said circulation pump and includes a three-way valve frame formed with a plurality of coupling holes for mating said three-way valve to said circulation pump, a ball space, a spherical ball placed within said ball space;

a first guide means, which is for supplying the first water to said heat exchanger and for supplying the first water heated within said heat exchanger to a user, and which includes a water supply pipe for supplying the first water from a first water supply source outside of said gas boiler to said heat exchanger, and a hot water supply pipe for supplying the first water heated within said heat exchanger to the user, said water supply pipe having a water valve for controlling the quantity of the first water supplied into said heat exchanger via said water supply pipe;

a second guide means, which is for circulating the heated second water between said three-way valve and said heat exchanger by an operation of said three-way valve when the operational mode of said gas boiler is the hot water mode, and directing the heated second water to a heating place by the operation of said three-way valve when the operational mode of said gas boiler is the heating mode, where said second guide means comprises a second communicating pipe, a first heating water supply pipe, a second heating water supply pipe and a heating water discharge pipe, whereby said three-way valve shuts off said heating water discharge pipe to upwardly flow the heated second water into said circulation pump via said second communicating pipe when the operational mode of said gas boiler is the hot water mode, and shuts off said second communicating pipe to discharge the heated second water to the heating place via said heating water discharge pipe when the operational mode of said gas boiler is the heating mode;

a heating water return pipe for guiding the second water returning from the heating place into said water tank;

a first communicating pipe extending from the lower right end of said water tank to said circulation pump for guiding the second water directed into said water tank into said circulation pump; and a printed circuit board box having a printed circuit board therein for controlling the operation of said gas boiler.

16. A gas boiler as claimed in claim 15, wherein said second communicating pipe allows for fluid communication between said circulation pump and said three-way valve, said first heating water supply pipe allows for the fluid communication between said circulation pump and said heat exchanger, and said second heating water supply pipe allows for the fluid communication between said heat exchanger and said three-way valve.

17. A gas boiler as claimed in claim 15, wherein said second communicating pipe extends from the pump space to said ball space of said three-way valve.

18. A gas boiler as claimed in claim 15, wherein said ball shuts off an upper end of said heating water discharge pipe to upwardly flow the heated second water into said circulation pump via said second communicating pipe in accordance with a control signal from the printed circuit board when the operational mode of said gas boiler is the hot water mode, and shuts off a lower end of said second communicating pipe to discharge the heated second water via said heating water discharge pipe in accordance with the control signal from the printed circuit board when the operational mode of said gas boiler is the heating mode.

19. A gas boiler comprising:

a water tank having a rectangular section, and including an upper casing having a lower portion opened and a lower casing having an upper portion opened, said upper casing includes a first flange formed along the lower marginal periphery of said upper casing for coupling said upper casing to said lower casing, and said lower casing shaped as an upside down step includes a second flange formed along the upper marginal periphery of said lower casing for coupling said upper casing to said lower casing, and includes a third flange formed along the right marginal periphery of said lower casing whereby said first flange and said second flange are coupled together;

a heat exchanger for heating a first water and a second water, and which includes a heat exchanger which comprises a heating water tank for retaining the second water, a combustion chamber, and a gas burner for heating the second water retained within said heating water tank;

a circulation pump, which is mounted to the lower portion of said water tank and includes a circulation pump frame formed with a plurality of coupling holes for joining said circulation pump to said water tank and to said three-way valve, a heating water inlet hole, a pump entrance, a pump space, and a pump drain pipe;

a three-way valve, mounted to the lower portion of said circulation pump and includes a three-way valve frame formed with a plurality of coupling holes for mating said three-way valve to said circulation pump, a ball space, a spherical ball placed within said ball space;

a first guide means, which is for supplying the first water to said heat exchanger and for supplying the first water heated within said heat exchanger to a user, and which includes a water supply pipe for supplying the first water from a first water supply source outside of said boiler to said heat exchanger, and a hot water supply pipe for supplying the first water heated within said heat exchanger to the user, said water supply pipe having a water valve for controlling the quantity of the first water supplied into said heat exchanger via said water supply pipe;

a second guide means, which is for circulating the heated second water between said three-way valve and said heat exchanger by an operation of said three-way valve when the operational mode of said gas boiler is the hot water mode, and directing the heated second water to a heating place by the operation of said three-way valve when the operational mode of said gas boiler is the heating mode, where said second guide means comprises a second communicating pipe, a first heating water supply pipe, a second heating water supply pipe, and a heating water discharge pipe, said second communicating pipe allows for fluid communication between said circulation pump and said three-way valve, said first heating water supply pipe allows for the fluid communication between said circulation pump and said heat exchanger, and said second heating water supply pipe allows for the fluid communication between said heat exchanger and said three-way valve, said second communicating pipe extends from the pump space to said ball space of said three-way valve, whereby said three-way valve shuts off said heating water discharge pipe to upwardly flow the heated second water into said circulation pump via said second communicating pipe when the operational mode of said gas boiler is the hot water mode, and shuts off said second communicating pipe to discharge the heated second water to the heating place via said heating water discharge pipe when the operational mode of said gas boiler is the heating mode;

a heating water return pipe for guiding the second water returning from the heating place into said water tank;

a first communicating pipe extending from the lower right end of said water tank to said circulation pump for guiding the second water directed into said water tank into said circulation pump; and a printed circuit board box having a printed circuit board therein for controlling the operation of said gas boiler, wherein said ball shuts off the upper end of said heating water discharge pipe to upwardly flow the heated second water into said circulation pump via said second communicating pipe in accordance with a control signal from the printed circuit board when the operational mode of said gas boiler is the hot water mode, and shuts off the lower end of said second communicating pipe to discharge the heated second water via said heating water discharge pipe in accordance with the control signal from the printed circuit board when the operational mode of said gas boiler is the heating mode.

* * * * *